US006077020A

United States Patent [19]

Neufeldt et al.

[11] Patent Number: 6,077,020

[45] Date of Patent: Jun. 20, 2000

[54] GARBAGE OR RECYCLABLE MATERIALS HANDLING SYSTEM

[75] Inventors: Dennis Neufeldt, Coaldale; Simon Hann; Lloyd Darren, both of Lethbridge, all of Canada

[73] Assignee: Haul-All Equipment Ltd., Lethbridge Alberta, Canada

[21] Appl. No.: 09/232,924

[22] Filed: Jan. 19, 1999

Related U.S. Application Data

[63] Continuation of application No. PCT/CA97/00757, Oct. 15, 1997.

[30] Foreign Application Priority Data

Oct. 15, 1996 [CA] Canada ..... 2187856

[51] Int. Cl.[7] ..... B65F 3/00

[52] U.S. Cl. ..... 414/399; 414/406; 414/408; 414/584; 222/166

[58] Field of Search ..... 414/373, 389, 414/397, 399, 401, 406, 408, 421, 425, 470, 582, 584; 222/164, 166

[56] References Cited

U.S. PATENT DOCUMENTS

| | | | |
|---|---|---|---|
| 2,822,113 | 2/1958 | Joiner, Jr. | 414/421 X |
| 3,042,237 | 7/1962 | Dole . | |

(List continued on next page.)

FOREIGN PATENT DOCUMENTS

| | | |
|---|---|---|
| 440843 | 4/1945 | Canada . |
| 937204 | 11/1973 | Canada . |
| 1017714 | 9/1977 | Canada . |
| 1109830 | 9/1981 | Canada . |
| 2074405 | 1/1994 | Canada . |
| 0 388 295 A1 | 3/1990 | European Pat. Off. . |
| 576 405 A1 | 5/1993 | European Pat. Off. . |

OTHER PUBLICATIONS

Haul–All—Refuse Collection System System Brochure—4 pgs.
Emco Works—Brochure 4 pgs.
Emco RC–30 Body—Brochure 2 pgs.
EMCO—Makes It Work Brochure—6 pgs.
Wittke—The Printer Automated Side Loader Brochure—2 pgs.
Heil—Automated Side Loader—7 pgs.
Heil—Automated Refuse Collection—9 pgs.
Rapid Rail Systems—2 pgs.
Heil Rapid Rail Automated Side Loader—3 pgs.
Wayne Curbtender—Automated Side–Loader—3 pgs.
International Search Report and Annex—3 pgs.
Interntional Search Report and Annex dated Feb. 23, 1998.

*Primary Examiner*—Douglas Hess
*Attorney, Agent, or Firm*—John W. Ross; Killworth, Gottman, Hagan & Schaeff, L.L.P.

[57] ABSTRACT

A garbage or recyclable material handling system uses material containers each pivotally mounted to respective supports at desired locations for movement between a lower material receiving position and a partially inverted material discharge position. At least one materials collection vehicle is provided to communicate with respective containers when in the discharge position to receive the materials discharged therefrom. This vehicle has an actuator assembly mounted thereto including an arm extendible outwardly of the vehicle and having an actuator secured to a distal end of the arm. The arm is adapted to be positioned to operatively engage between the support and the container (when the vehicle is located to receive the materials from the container) and to exert forces therebetween to cause the container to pivot from the receiving position to the discharge position to effect material discharge into the vehicle and to thereafter cause or permit the container to pivot back to the lower receiving position following which the actuator can be disengaged and the arm retracted inwardly toward the vehicle to allow the vehicle to move away from the container.

17 Claims, 10 Drawing Sheets

U.S. PATENT DOCUMENTS

| | | | |
|---|---|---|---|
| 3,730,396 | 5/1973 | Harper et al. | 222/166 |
| 3,744,651 | 7/1973 | Verschoof | 414/572 |
| 3,752,335 | 8/1973 | Gomez | 414/572 |
| 3,814,270 | 6/1974 | Murphy . | |
| 3,891,106 | 6/1975 | Alcanzare . | |
| 4,103,790 | 8/1978 | Neufeldt | 414/572 |
| 4,175,903 | 11/1979 | Carson . | |
| 4,280,780 | 7/1981 | Neufeldt | 414/572 |
| 4,363,588 | 12/1982 | Stickney . | |
| 4,580,940 | 4/1986 | Sheaves | 414/406 |
| 4,859,135 | 8/1989 | Neufeldt | 414/399 X |
| 4,946,331 | 8/1990 | Johnson . | |
| 4,978,271 | 12/1990 | Seader . | |
| 5,039,271 | 8/1991 | Julian . | |
| 5,299,856 | 4/1994 | Grosz | 298/11 |
| 5,344,272 | 9/1994 | Nuyts | 414/421 X |
| 5,807,056 | 9/1998 | Osborn et al. | 414/406 |

GARBAGE OR RECYCLABLE MATERIALS HANDLING SYSTEM

This is a continuation of our application PCT/CA97/00757 filed Oct. 15, 1997.

BACKGROUND OF THE INVENTION

This invention relates generally to improvements in garbage or recyclable materials handling systems.

The prior art has provided a wide variety of garbage and recyclable materials collection equipment. One problem with traditional front loading collection trucks is that they typically require a minimum of 15 meters (50 feet) directly in front of the bin to be collected. Sloped streets also pose difficulties for these vehicles as the front loading collection trucks require the bin to be substantially level with the pick-up forks while traditional rear loading bins have wheels which can cause handling problems on slopes. Bins with wheels also require two or more persons to move them into place so that they can be tipped into the hopper of a rear loading truck. Wheeled bins are also a problem in locations where a "permanent" site is desired such as a recycling depot. A site can quickly lose its functionality if the bins are disoriented. Furthermore, the lifting of front or rear loading bins creates more stress on the lids resulting in distortions and failures. Open lids are not only unsightly but are unsanitary and make the bins more susceptible to animals and fire.

Canadian Patent No. 1,012,500 issued Jun. 21, 1977 to the assignee of the present invention describes a refuse vehicle which is provided with a side mounted refuse receiving, loading and compacting bucket. This general arrangement has been operated successfully on a commercial basis for many years. Essentially the bucket is designed to provide a large loading capacity capable of receiving several times the volume of conventional domestic trash cans to avoid the inefficient need of unloading the bucket at frequent intervals. The bucket is movable from a loading position to a transport position in which the bucket doubles as the side wall of the dump body and is also movable from a transport position to a refuse compacting position disposed within the truck body and therefore almost fully eliminates the considerable space consumed by the compacting assembly of conventional refuse vehicles.

A further advantage of the above-described side mounted loading bucket is that it can be used advantageously with stationary self-dumping refuse containers of the type as described in Canadian Patent No. 1,072,511 owned by the present assignee and issued on Feb. 26, 1980 (see also U.S. Pat. No. 4,208,780). These self-dumping containers typically include a base which may be rigidly secured to a concrete pad and a hopper which is pivotally secured to the base and which is pivoted by hydraulic cylinders between a lower loading position and an elevated discharge position. The combination of the side mounted vehicle bucket and the self-dumping refuse container renders the collection of refuse from parks, apartment complexes and industrial sites extremely simple and efficient as compared to earlier arrangements. These self-dumping containers may also be provided with relatively heavy discharge lids and loading lids with latch means rendering them substantially inaccessible to animals.

In addition to being very effective in keeping very large animals, particularly bears, out of the garbage, these self-dumping units lend themselves to more aesthetic designs as the stationary container allows more flexibility in the design and therefore makes for a container which is well suited for locating or siting in high profile locations. The container can also maintain its good looks for an extended period of time because the collection vehicle is never required to make actual contact with the container to empty the contents. The above-noted problems of access are substantially eliminated since a side loading collection vehicle can access a self-dumping bin merely by driving along side of it. One example would have the collection truck on the road emptying a stationary container on the opposite side of the sidewalk. Another example would be where a cluster of these containers has been laid out as in a recycling depot. A stationary self-dumping container can be collected using the normal driving lanes in a parking lot while in contrast a typical front loader would need a large amount of space for each container. Furthermore, since the stationary bin does not have to be actually lifted by the collection truck, smaller collection vehicles can be used thus providing advantages in terms of both capital and operating costs. Additionally, because the stationary self-dumping container involves the dumping of material into the side mounted loading and compacting bucket, there is an opportunity to inspect the material before it enters the compactor. This is particularly useful in recycling applications to check for unwanted materials or contaminants.

The self-dumping stationary container assembly described in the above-noted Canadian Patent No. 1,072,511 and U.S. Pat. No. 4,208,780 includes all of the advantages noted above and it has proven to provide a cost effective solution in many applications where the required storage capacity is in the range of two to six cubic yards. However, the self-dumping container does have a number of disadvantages.

The first disadvantage is in terms of cost. Since the self-dumping container requires an actuating device, most usually in the form of hydraulic cylinders, as well as the plumbing and brackets to go with it, the initial capital cost is substantially higher than a typical front or rear loading bin where the lifting mechanism is on the collection truck or vehicle. Although there are operational efficiencies that mainly compensate for this additional container cost in many applications, the initial capital cost remains a barrier to more widespread acceptance.

Another problem is that of hydraulic fluid leakage. The most economical method of actuating the hydraulic cylinders is to provide pressurized hydraulic fluid from a pump on the refuse vehicle through quick couplers. However, these couplers are subject to some leakage as the result of extreme temperature changes as well as hook-up and disconnect procedures. This leakage is not a problem functionally but can create some problems environmentally and aesthetically.

Another problem with the hydraulically activated self-dumping containers is the consumer perception that the hydraulic components within the container system create extra operational down-time and extra maintenance.

Other known types of refuse collection systems employ truck mounted semi-automated or automated lifting arms. The semi-automated arm systems are limited to what the operator can physically move to the collection vehicle. Automated arms are more flexible in that they can reach for a container but they still have to hook onto or clamp onto the container to pick it up and empty it. This requires the container to be properly located, limits the container design and restricts its size. The fact that the containers have to lifted during the dumping process subjects them to the disadvantages noted above in comparison with the stationary self-dumping containers. When smaller containers are used they are prone to being blown over in the wind, difficult for individuals to manoeuvre, especially in winter conditions, and are susceptible to animal access.

It is therefore desirable to provide a system which incorporates the advantages of the several systems noted above and which therefore is capable of enjoying widespread application and increased commercial value.

SUMMARY OF THE INVENTION

It is accordingly an object of the present invention to provide garbage/recyclable material containing and handling systems which overcome the major disadvantages while maintaining most of the advantages associated with the stationary self-dumping containers noted above.

It is a further object of the invention to provide apparatus incorporating many of the advantages of automated and semi-automated arm systems while overcoming many of their limitations.

It is also an object of the present invention to provide apparatus of the type noted above which is substantially animal-proof but still user friendly.

It is a general object of the present invention to provide garbage/recyclable material handling systems and apparatus which is capable of operating in tight locations and/or under adverse slope conditions and which permits the use of aesthetically designed containers which can be located in high profile areas rather than in behind residential or commercial buildings and the like.

Accordingly, in one aspect of the invention there is provided an actuator assembly for use in a garbage or recyclable material handling system wherein material containers are each pivotally mounted to respective supports at desired locations for movement between a lower material receiving position and a partially inverted material discharge position and wherein a material collection vehicle is adapted to communicate with respective containers when in the discharge position to receive the materials discharged therefrom; said actuator assembly comprising an arm adapted to be attached to the vehicle and extendable outwardly of the vehicle during use, and an actuator secured to a distal end of the arm, which actuator is adapted to be positioned to operatively engage between the support and the container when the vehicle is located to receive said materials from a selected container and operable to exert forces between the support and container to cause the container to pivot from the receiving position to the discharge position to effect discharge into the vehicle and to thereafter cause or permit the container to pivot back to the lower receiving position following which said actuator can be disengaged and said arm retracted inwardly toward the vehicle to allow the vehicle to move away from the container.

In one particular form of the invention said actuator has means thereon which, in use, are mutually co-operable with the container and support and permitting secure pivoting of the container relative to the support when the actuator is engaged therebetween while permitting generally ready or rapid engagement and disengagement of the actuator with and from the container and support only when the container is in its lower material-receiving position.

In a preferred form of the invention said actuator includes a fluid cylinder having said co-operable means mounted thereto and operable between extended and retracted positions defining the material discharge and receiving positions respectively of the container.

Still further according to an embodiment of the invention opposing ends of said fluid cylinder have said co-operable means thereon to provide for the ready or rapid engagement and disengagement of the actuator.

The actuator assembly, according to any of the embodiments noted above, is particularly adapted for use with a vehicle having a side-mounted loading bucket thereon and wherein said arm is sufficiently long or extendible as to permit said actuator to be placed into said operative engagement between the container and support when the vehicle is located with its bucket alongside the container to receive the material therefrom.

In another preferred form of the invention said arm comprises a linkage mechanism capable of being folded into proximity with the frame of the vehicle to define the retracted condition of the actuator arm.

The invention also provides in a further aspect a garbage or recyclable material handling system which incorporates in combination the several components noted above, e.g. the material containers at spaced apart desired locations and at least one materials transporting vehicle having an actuator assembly thereon as described above.

In accordance with a still further feature of the invention there is provided an improved container assembly for use in a garbage or recyclable materials handling system as described above wherein the container is particularly adapted and configured for use with the actuator assembly referred to above.

These and other features and aspects of the invention will become readily apparent from the detailed description of preferred embodiments which follows taken in conjunction with the appended claims.

BRIEF DESCRIPTION OF THE VIEWS OF DRAWINGS

DETAILED DESCRIPTION OF THE PREFERRED EMBODIMENT

Figure 1:
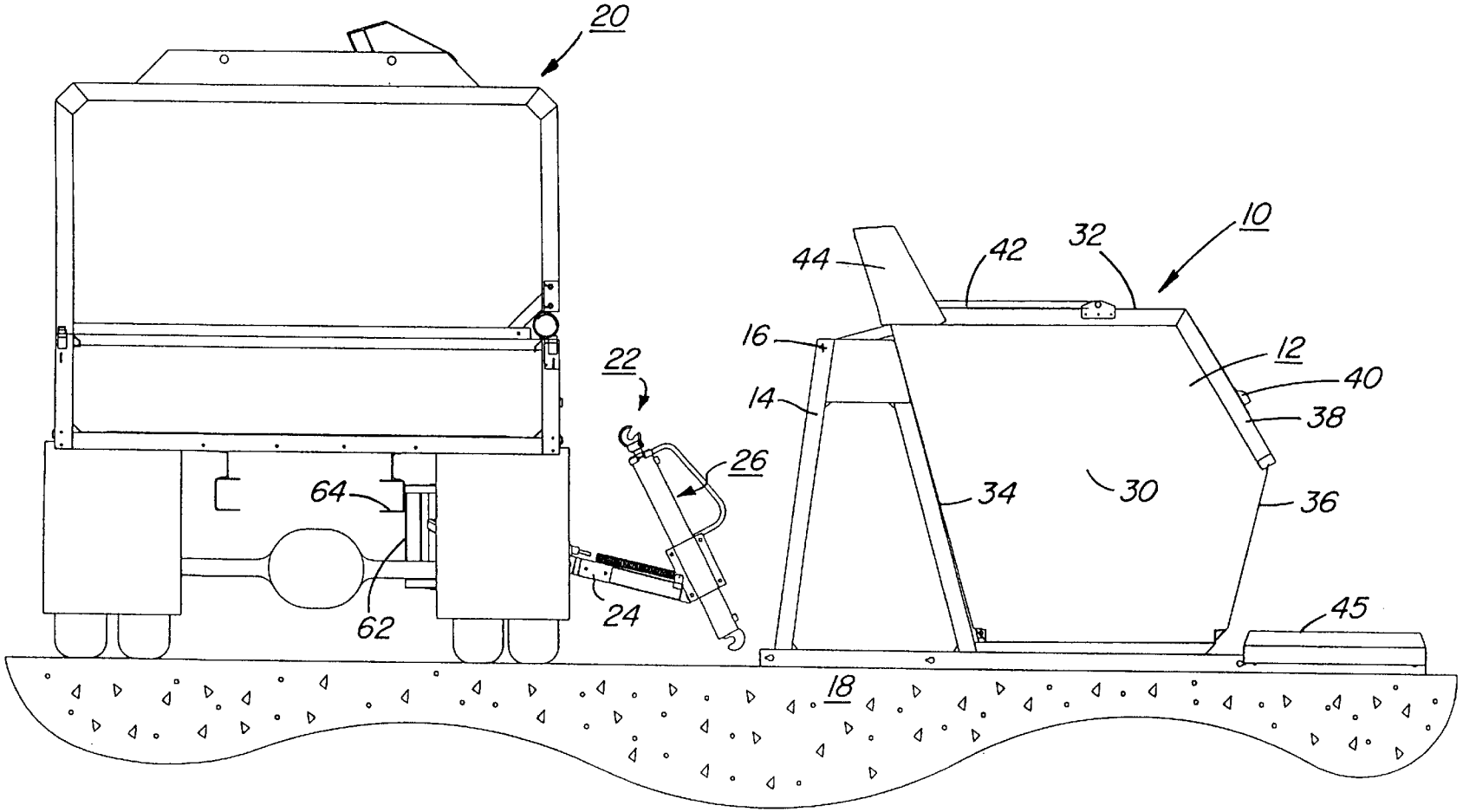
FIG. 1 is an end elevation view of the overall system showing the container assembly in the material receiving position with the partially extended actuator assembly attached to the chassis frame of the materials collecting and transporting vehicle which is positioned to receive materials from the container assembly.
Figure 2:
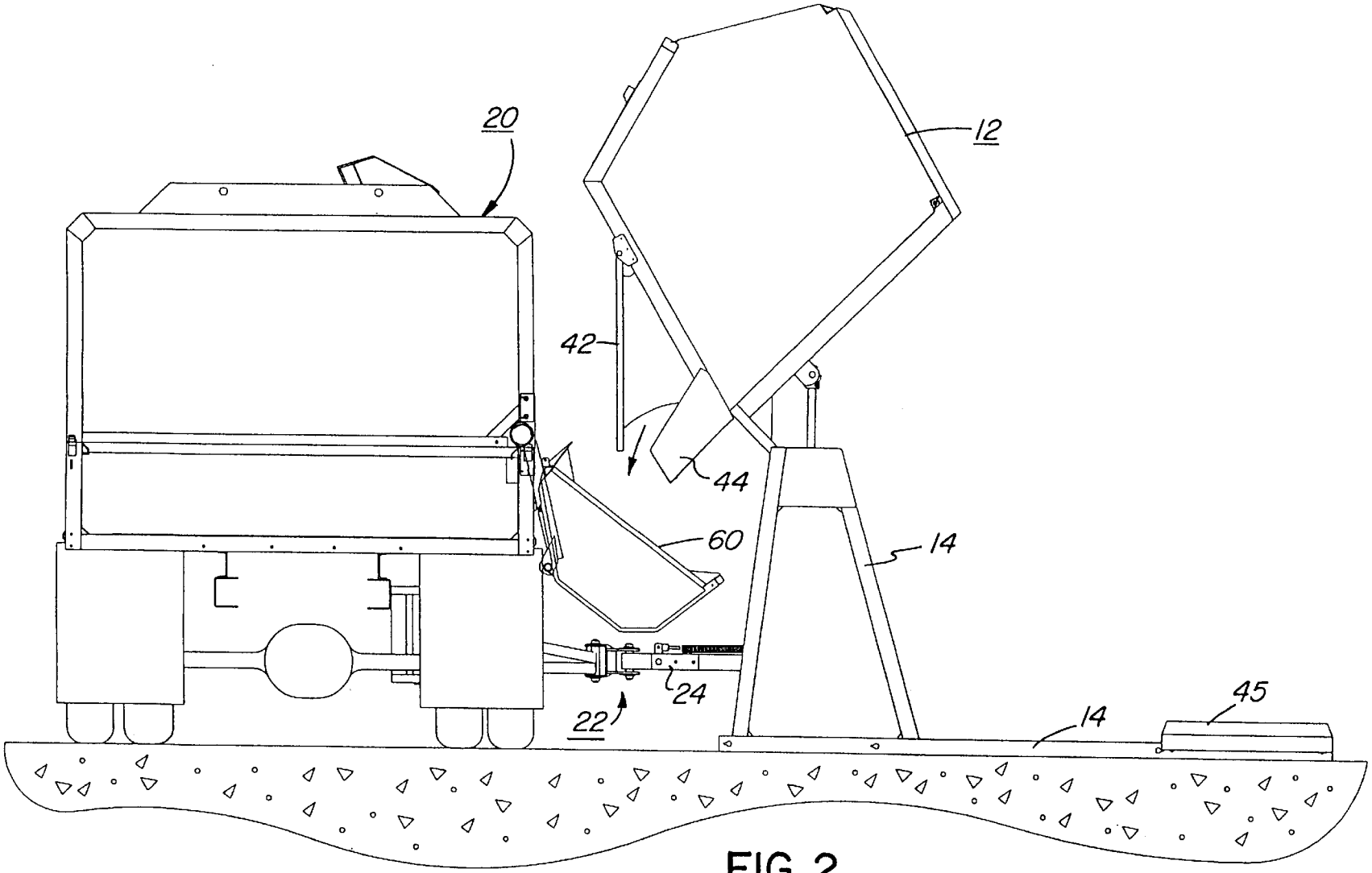
FIG. 2 is an end elevation view somewhat similar to FIG. 1 but wherein the actuator assembly has been positioned and activated thereby to pivot the container into the dumping position, the side bucket of the materials collecting vehicle being open to receive the materials from the container.

The garbage/recyclable materials handling system in accordance with the invention is clearly illustrated in FIGS. 1 and 2 wherein there is shown a container assembly 10 comprising a container 12 pivotally mounted for rotation about axis 16 on a support in the form of frame 14 which in turn is mounted to a solid base 18. The container 12 is pivotally mounted in this fashion for movement between the lower material receiving position shown in FIG. 1 and the partially inverted material discharge position shown in FIG. 2.

Container 12 is constructed and arranged to communicate with the inlet of a materials collection vehicle 20 when the container is in the discharge position shown in FIG. 2 so that this vehicle may receive the discharged materials.

In accordance with the present invention the collection vehicle has an actuator assembly 22 mounted thereto, the latter including an arm 24 which is extendible outwardly of the vehicle as illustrated in FIG. 2. The distal end of the arm 24 has an actuator 26 mounted thereon.

The container assembly is constructed to receive the actuator 26 and is provided with means (to be described hereinafter) to enable the actuator 26 to be positioned such as to operatively engage between the frame 14 and the container 12 when the collection vehicle 20 is located generally as illustrated in FIGS. 1 and 2 to receive materials from the container. The actuator 26 is capable of exerting forces between the container 12 and the frame 14 sufficient as to cause the container to pivot from the receiving position shown in FIG. 1 to the discharge position shown in FIG. 2 and to thereafter cause or permit the container 12 to pivot back to the lower receiving position. Following this, the actuator 26 is then manually disengaged and removed from the container assembly 10 and the arm 24 retracted inwardly toward the vehicle and into the position illustrated in FIG. 3 thereby to allow the collection vehicle 20 to move away from the container assembly.

Since most of the basic features of the container have been previously described in the above-noted Canadian Patent 1,072,511 and the counterpart U.S. Pat. No. 4,208,780, only a brief description of same needs to be presented here. Briefly, the container 12 includes a bottom wall, opposed end walls 30, a top wall 32, a rear wall 34 and a front wall 36. The upper portion of the front wall is provided with a pair of hinged loading doors 38 for use by persons depositing garbage etc. into the container, such doors being provided with animal proof latches 40. The top wall 32 of the container is provided with a heavy pivoting discharge door 42 which cannot be opened by animals such as bears when the container is in the lower receiving position. However, when the container is pivoted upwardly to the discharge position this door 42 opens so as to allow the materials to be dumped outwardly and directed by a discharge chute 44 into the side mounted loading bucket of the collection vehicle.

Figure 5:
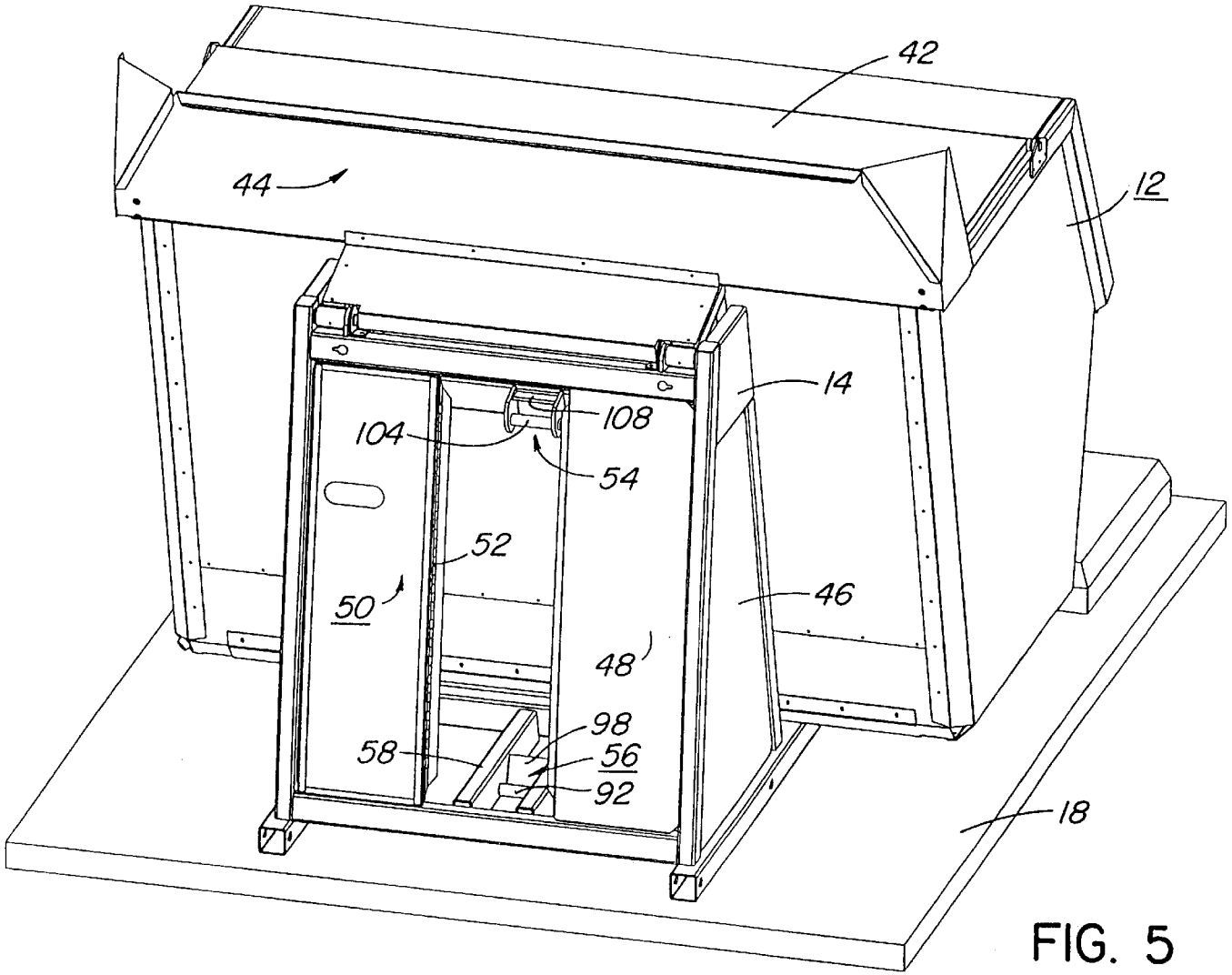
FIG. 5 is a perspective view of the dumping side of the container assembly with its rear door open and ready to accept the actuating assembly.
Figure 6:
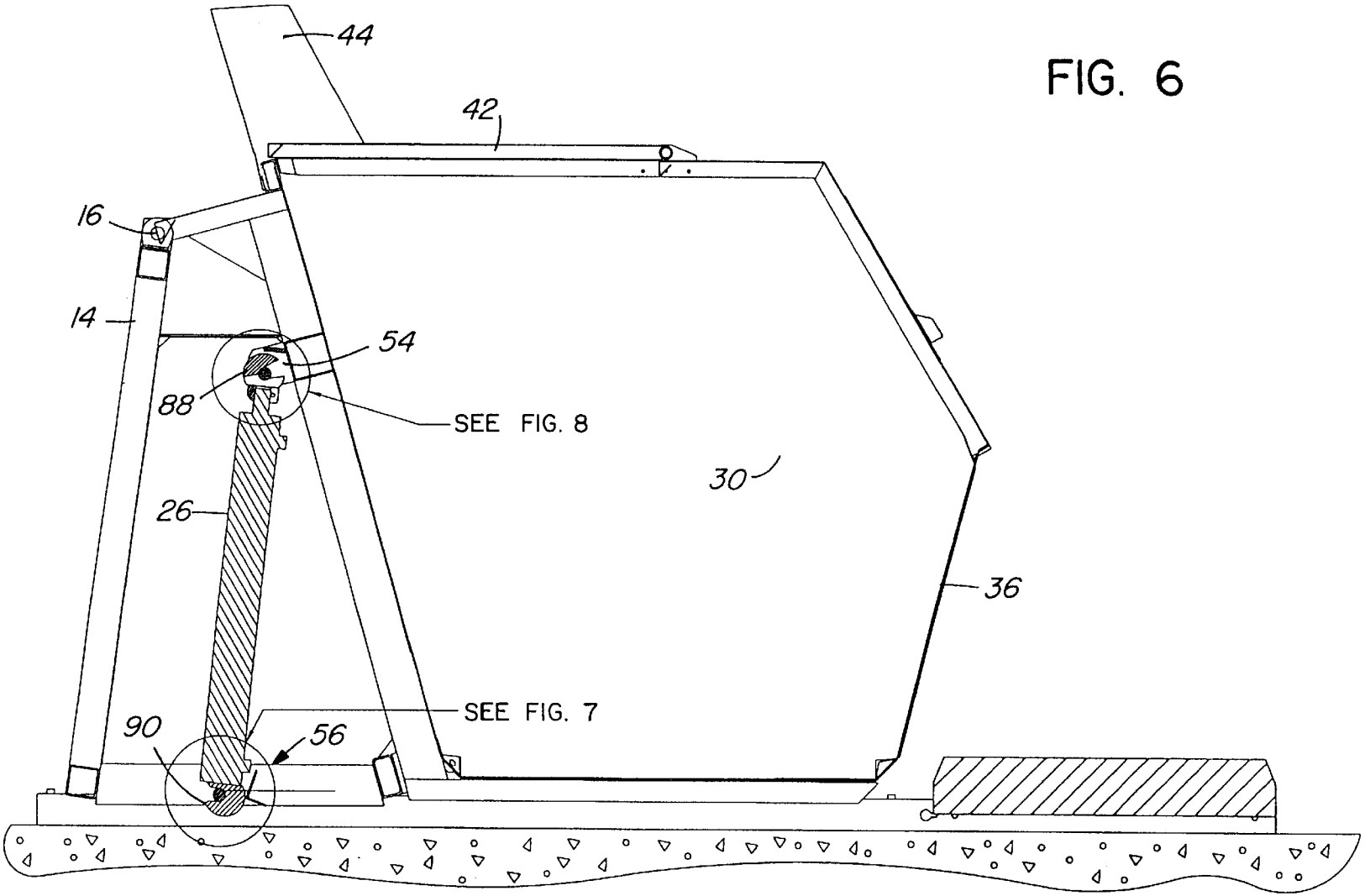
FIG. 6 is a cross-section view of the container assembly with the actuator positioned in place and engaged between the frame and container and ready to pivot the container about the base-mounted frame.

As noted previously, the container 12 is pivotally mounted to the frame 14 for rotation about the axis 16 shown most clearly in FIG. 6. The frame 14 is of a sturdy welded construction comprising a plurality of tubular members welded together to provide the required strength and rigidity. The lower part of the frame extends forwardly and is desirably provided with a heavy platform counterweight 45. This frame is provided with opposed end walls 46 and a rear wall 48 which fully encloses the interior of the frame 14 when the container 12 is in its lower material receiving position as illustrated in FIG. 5 for example. However, the rear wall 48 is provided with a centrally located door 50 which is hinged at 52 so that it may be readily opened as seen in FIG. 5 to gain access to the interior space defined by the frame 14. When the door is open, as illustrated in FIG. 5, the upper (54) and lower (56) engagement means which co-operate with the actuator 26 as hereinafter described are clearly visible. The upper engagement means 54 is mounted to the container 12 via suitable transverse frame members while the lower engagement means 56 is mounted to the frame 14 via suitable short frame sections thereby to provide the strength necessary to resist the forces exerted by the actuator as described hereinafter.

The collection vehicle need be described only very briefly since in principle it may correspond to the structure described in the above-noted Canadian Patent No. 1,012,500 issued Jun. 21, 1977. This collection vehicle, as noted previously, is provided with a side mounted materials receiving, loading and compacting bucket 60. The bucket 60 is typically activated by hydraulic cylinders in the manner described in the above-noted Canadian patent. The bucket 60 is movable from the loading position shown in FIG. 2 to the transport position of FIG. 1 in which the bucket doubles as the side wall of the body. The bucket 60 is also movable from the transport position to a refuse compacting position (not shown) disposed within the body of the collection vehicle.

Figure 3:
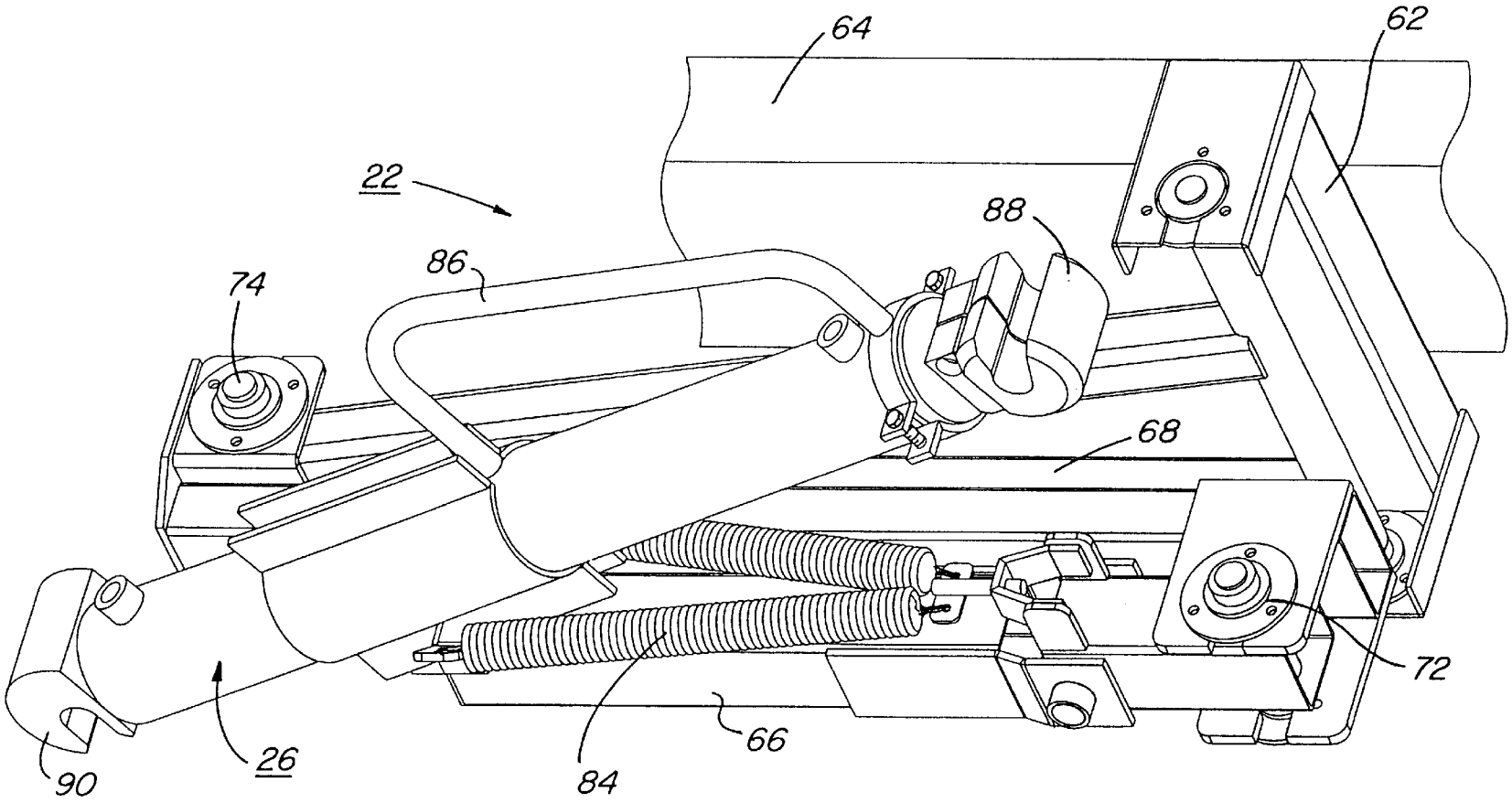
FIG. 3 is a perspective view of the actuator assembly shown attached to a typical chassis frame and in the retracted position for travelling from site to site.
Figure 4:
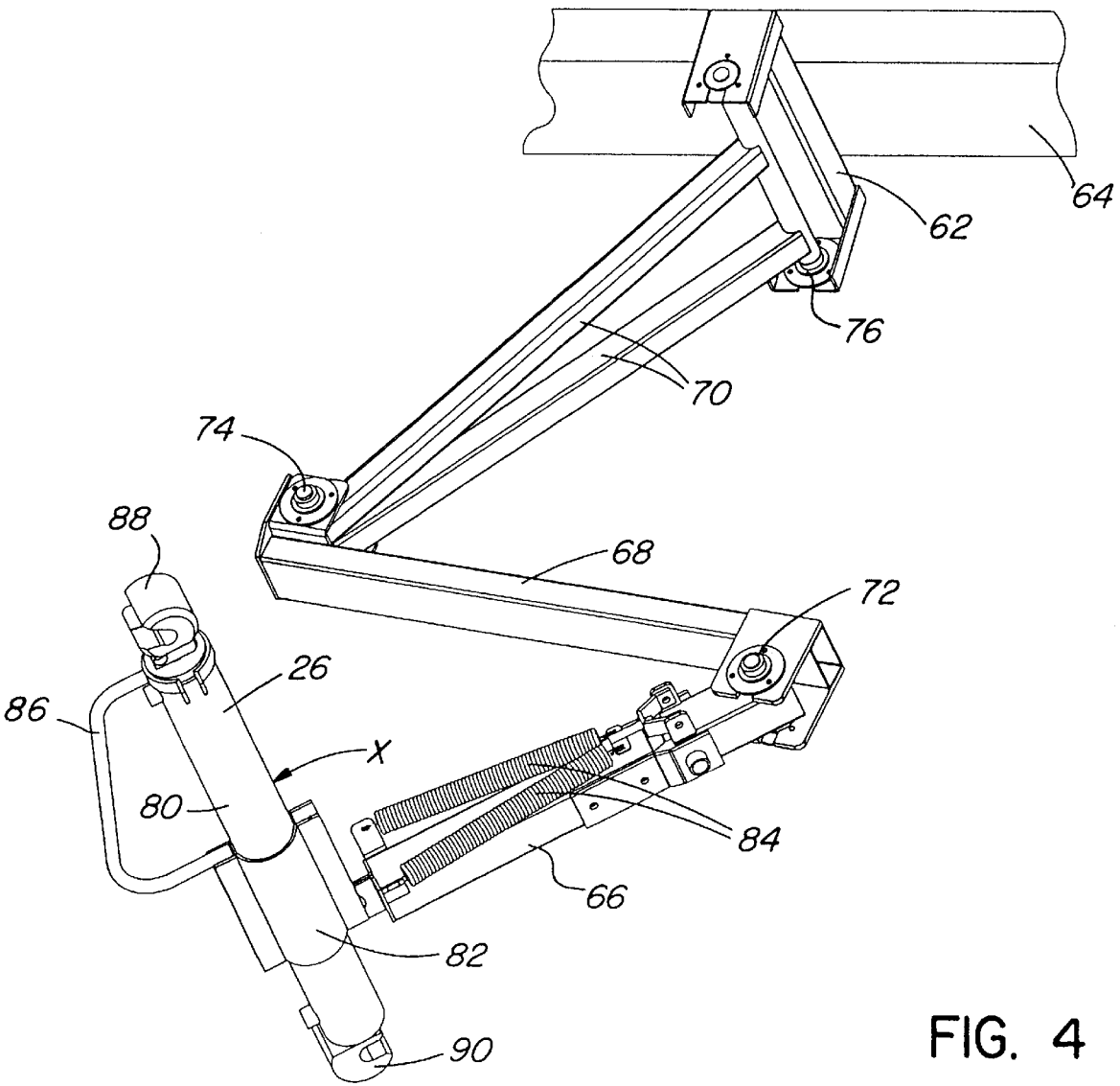
FIG. 4 is a perspective view of the actuator assembly in the semi-extended position ready to be inserted into a container assembly for actuation thereof.

The above-noted actuator assembly 22 is mounted to the vehicle chassis frame in the manner best illustrated in FIGS. 3 and 4. In particular, the actuator assembly includes a support bracket 62 which is welded or otherwise suitably secured to the vehicle chassis frame 64 at any convenient point forwardly of the rear vehicle wheel. The actuator 26 itself is mounted to the distal end of the arm 24 comprising a plurality of rigid links 66, 68 and 70 pivotally connected to each other and to the support bracket at pivot points 72, 74 and 76. When the arm is in the retracted position illustrated in FIG. 3 the rigid links 66, 68 and 70 lie in close proximity to one another, to chassis frame 64 and to the actuator. This is the compact storage position utilized when the collection vehicle is moving from one site to another.

The actuator 26 itself is in the form of a hydraulic cylinder 80 pivotally secured by a mounting bracket 82 to the distal end of the outermost link 66. A pair of coil tension springs 84 secured between the outermost link 66 and the mounting bracket 82 tend to tilt or rotate the actuator 26 in the direction given by arrow X. The actuator 26 is provided with an elongated, somewhat distorted, U-shaped handle 86 which enables the operator (not shown) to effectively grasp the actuator and to draw the actuator outwardly from the side of the collection vehicle (when it is the position as illustrated in FIG. 1) and to insert the actuator 26 through the open door in the rear wall 48 of the frame 14 and into operative engagement with the upper and lower engagement means 54, 56 referred to previously.

In order to provide the secure engagement required between the hydraulic actuator and the engagement means 54, 56, the opposing ends of actuator hydraulic cylinder 80 are provided with hook-like latches, the first or lower latch 90 being connected to the bottom or cylinder end of the hydraulic actuator 26 while the second or upper latch 88 is connected firmly to the ram of the hydraulic cylinder 80.

Figure 7:
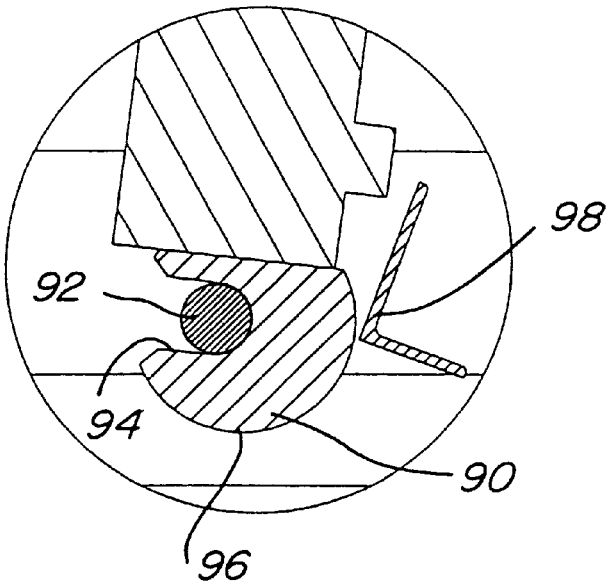
FIG. 7 is a detail cross-section view of the bottom engagement means for the actuator shown in FIG. 6.

As best illustrated in FIGS. 6–8 and 10–12, the upper and lower latches 88, 90 for the actuator 26 co-operatively engage with the upper (54) and lower (56) engagement means provided adjacent the rear or dumping side of the container assembly 10. As seen in the drawings, the actuator 26 is inserted through the open rear door and the lower latch 90 is hooked on to a fixed lower pin 92 forming a part of the lower engagement means 56. In order to achieve this, the actuator must be inserted lower end first into the lower engagement means 56 thereby to enable the lower pin 92 to enter into a slot 94 provided in the lower latch 90 and to seat firmly therein (FIG. 7). The outer periphery 96 of the lower latch 90 is smoothly arcuately contoured and this outer contoured peripheral surface 96 comes into close proximity with a fixed transverse guard channel 98 (FIG. 7) forming part of the lower engagement means 56 which prevents the lower latch 90 from escaping the lower pin 92 particularly after the actuator 26 has been manually rotated forwardly by the operator into the upright and slightly forwardly leaning position as illustrated in FIG. 6 thereby to bring the top latch 88 into the upper engagement means 54.

Figure 8:
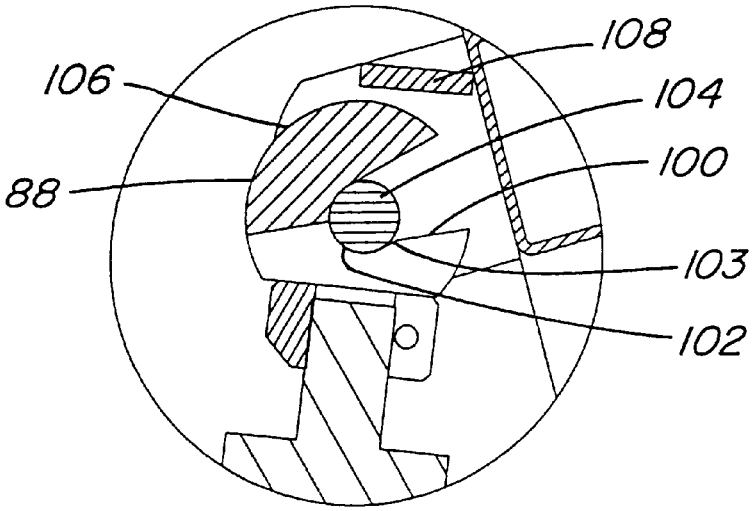
FIG. 8 is a detailed cross-section of the top engagement means for the actuator shown in FIG. 6.
Figure 9:
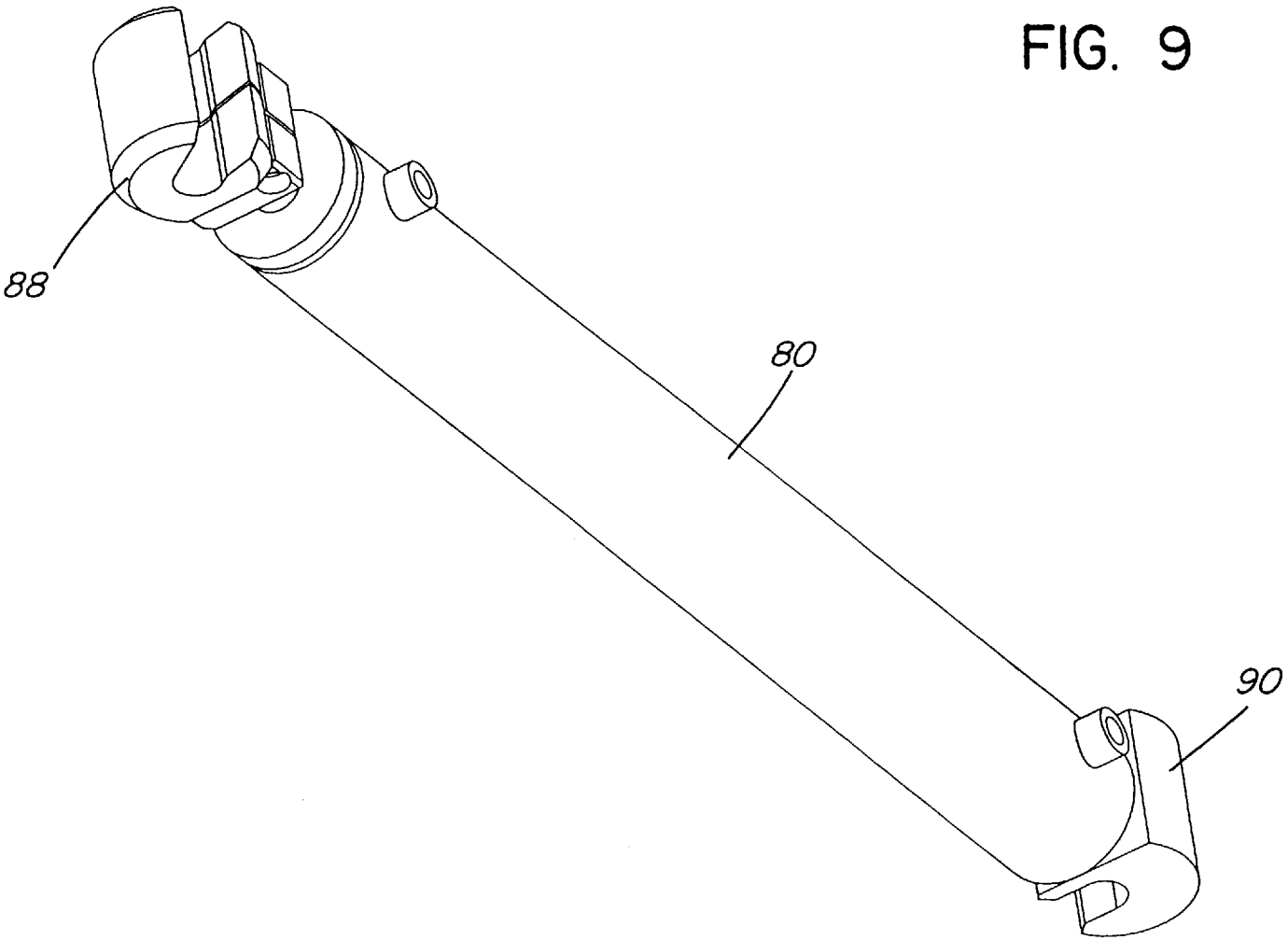
FIG. 9 is a perspective view of a typical actuator which is attached to the end of the extensible arm, which actuator serves to move the container from a lower receiving position to an at least partially inverted dumping position.
Figure 11:
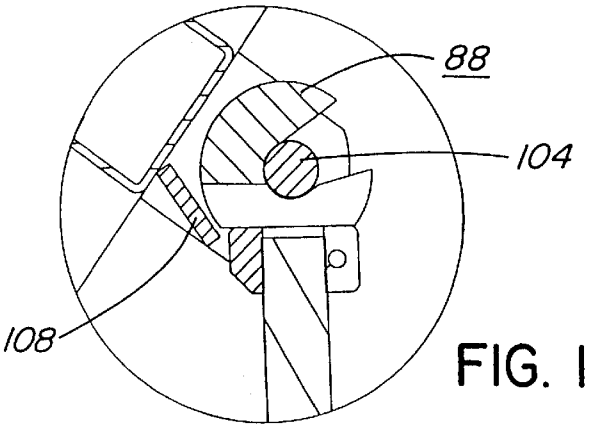
FIG. 11 is an enlarged cross-section of the top latch shown in FIG. 10.
Figure 12:
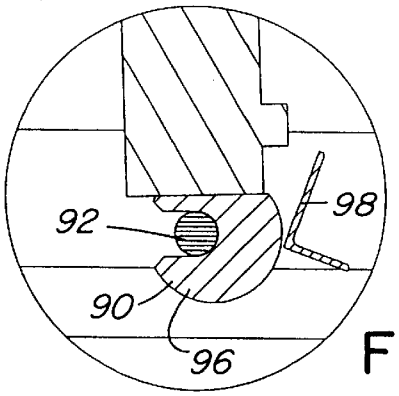
FIG. 12 is an enlarged cross-section view of the bottom latch shown in FIG. 10 in the dumping-fully locked position.

The top latch 88 as seen in FIG. 8 is provided with a downwardly and inwardly inclined slot 100 which converges slightly toward the bottom of the slot, with the semi-cylindrically shaped bottom 102 of the slot snugly receiving an upper pin 104 forming part of the upper engagement means 54. A shallow ridge 103 between the lower wall of slot 100 and the slot bottom 102 helps to retain pin 104 seated in the slot bottom especially just before and as the actuator begins to exert force on pin 104 in the upward direction. The outer periphery 106 of the top latch forms a smooth generally cylindrical surface. It will be seen that when the top latch 88 is positioned in full engagement with the upper pin 104, as illustrated in FIG. 8, that the outer periphery 106 of the top latch 88 is in close proximity to a top guard plate 108 fixed relative to pin 104 and forming part of the upper engagement means 54.

Figure 10:
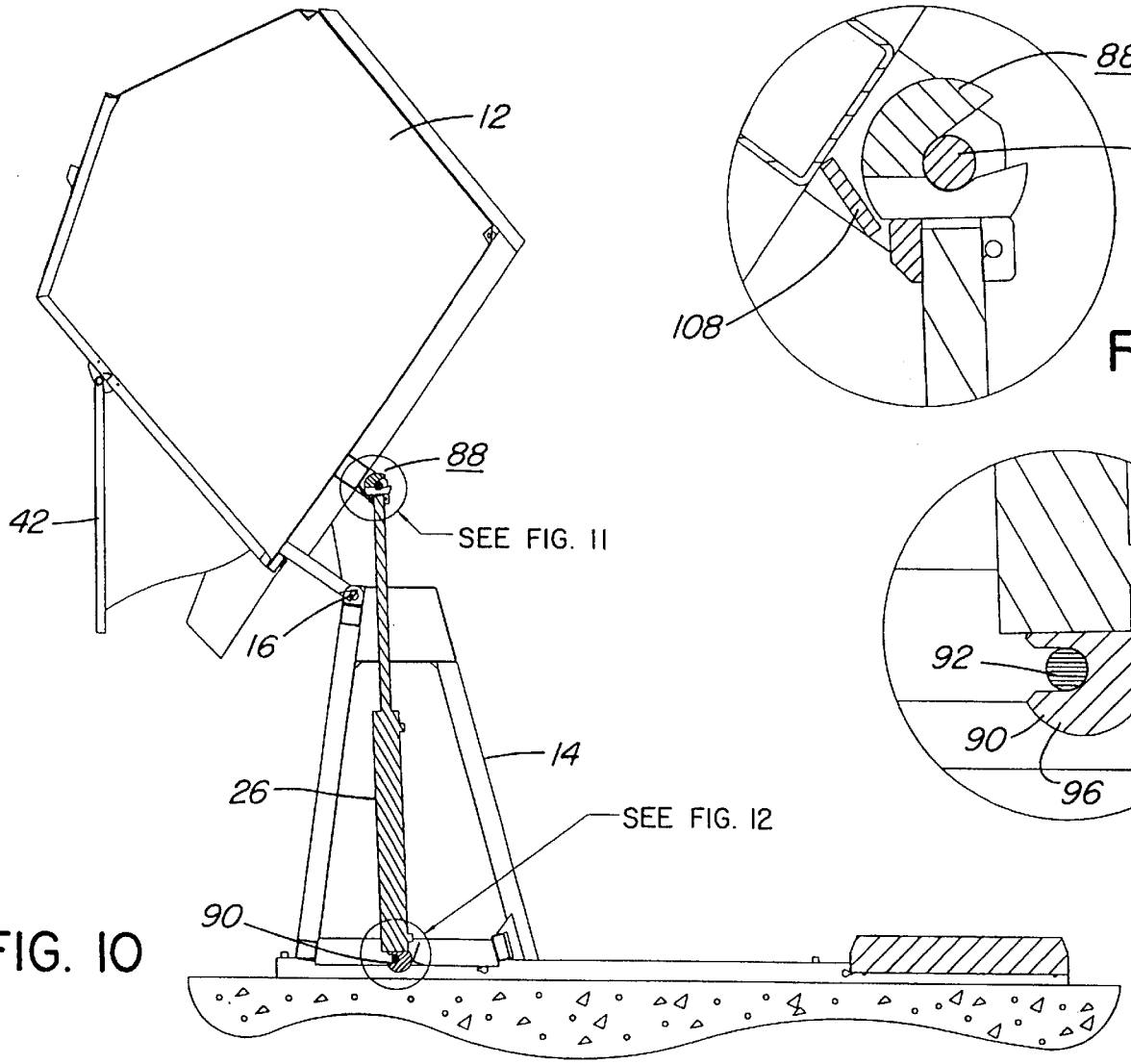
FIG. 10 is a cross-section view of the container assembly showing the container rotated to the dumping position together with details showing how the actuator is secured in position during the dumping cycle.
Figure 13:
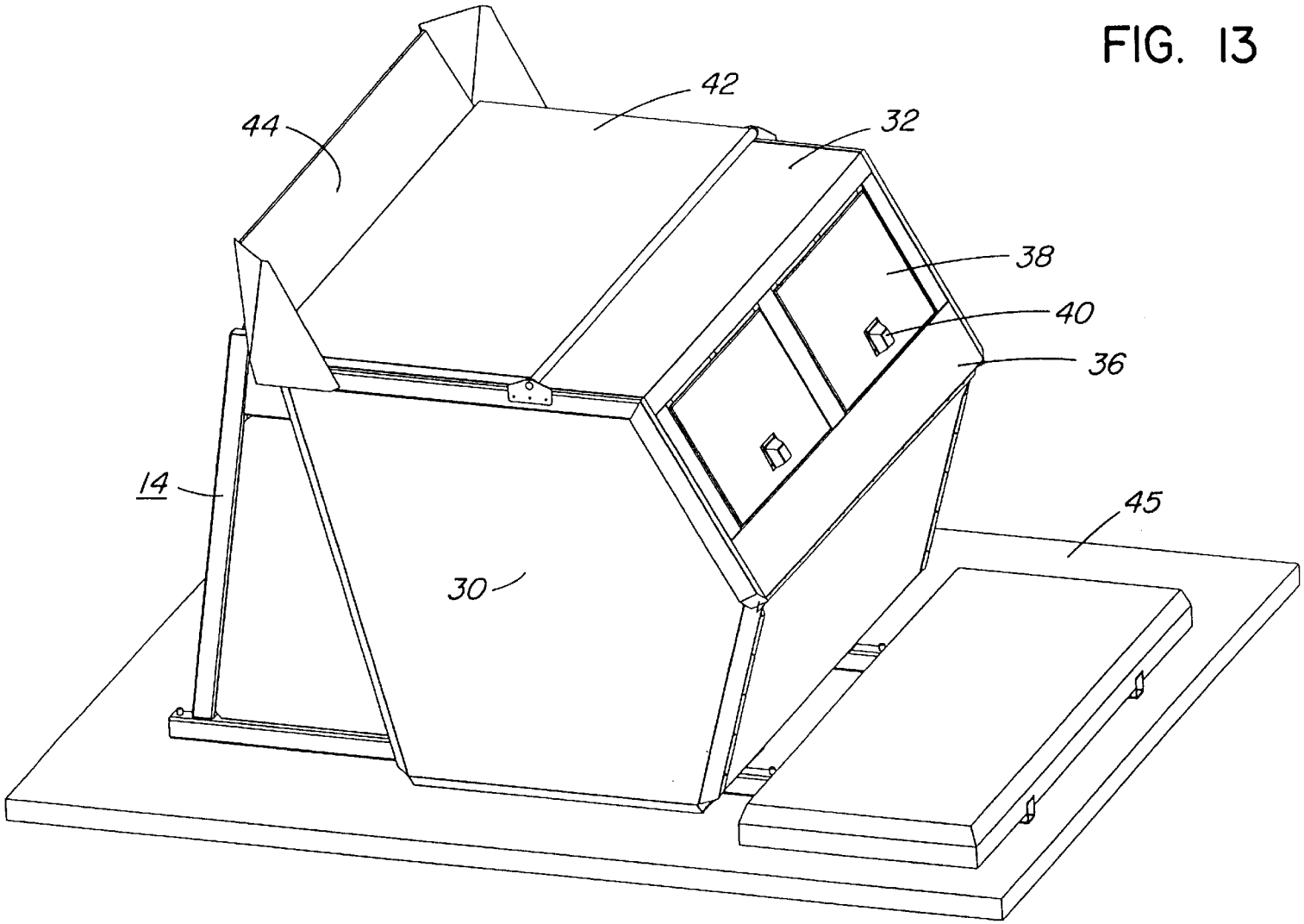
FIG. 13 is a perspective view of the loading side of the container assembly, the container being provided with two loading doors, the assembly having a user platform secured to the frame and the entire assembly secured to a mounting pad.

When the actuator 26 is activated by the operator by conventional hydraulic controls (not shown), the ram of the hydraulic cylinder 80 begins to extend gradually outwardly thus exerting forces between frame 14 and the container 12 via pins 92 and 104 and causing the container 12 to pivot about its pivot axis 16. As this action occurs, the top guard plate 108 rotates with the container 12 around the outer periphery 106 of the top latch 88 hence trapping it in place and thus ensuring that the top latch cannot escape the upper pin 104. Likewise, as the container 12 is pivoted in the manner described above, the lower guard channel 98 prevents the lower latch 90 from escaping the lower pin 92 and hence extension of the actuator 26 occurs until the fully tilted discharge position for the container 12 is reached as illustrated in FIG. 10. In this condition, the relative positions of the upper and lower engagement means 54, 56 and their associated top and bottom latches 88, 90 are illustrated (see FIGS. 11 and 12) and it will be readily seen how the associated guard plate 108 and guard channel 98 serve to secure the top and bottom latches 88, 90 of the actuator 26 in position on the associated pins 104, 92 thereby ensuring safe and secure pivoting of the container 12 at all times between its lower receiving position and its upper partially inverted discharge position.

After the contents of the container 12 have been dumped into the loading bucket 60 (FIG. 2), the hydraulic cylinder 80 is retracted by the operator thereby permitting the container 12 to return to its lower position and in this lower position, with the actuator 26 no longer carrying any load, the operator can then manually tilt the actuator counter-clockwise from the position shown in FIG. 6, for example, thereby to free the top latch 88 from the upper pin 104 with continued clockwise rotation of the actuator then being effected to the extent necessary to free the lower latch 90 from the lower pin 92 thus permitting complete removal of the actuator 26 from the enclosure defined by the frame 14. The hinged door 50 is then closed and the complete actuator assembly 22 is moved back into the retracted position adjacent the chassis frame of the vehicle as shown in FIG. 3 for travelling from site to site. At or before this point in time, the loading bucket 60 will have been activated so as to transfer its contents into the body of the collection vehicle 20 following which the vehicle then travels to a further collection site at which point the above-described process is again repeated.

A preferred embodiment of the invention has been described and illustrated by way of example. Those skilled in the art will realize that various modifications and changes may be made while still remaining within the spirit and scope of the invention. Hence the invention is not to be limited to the embodiment as described but, rather, the invention encompasses the full range of equivalencies as defined by the appended claims.

We claim:

1. An actuator assembly for use in a garbage or recyclable material handling system wherein material containers are each pivotally mounted to respective container supports at desired locations for movement between a lower material receiving position and a partially inverted material discharge position and wherein a material collection vehicle is adapted to communicate with respective containers when in the discharge position to receive the materials discharged therefrom;

said actuator assembly comprising an arm having one end portion adapted to be attached to the vehicle and said arm being extendable outwardly of the vehicle during use and an actuator secured to a distal end of the arm, which actuator is adapted to be positioned to operatively engage between the container support and the container when the vehicle is located to receive said materials from a selected container with said actuator being operable to exert forces between the container support and the container to cause the container to pivot from the lower receiving position to the discharge position to effect discharge of said materials into the vehicle and to thereafter cause or permit the container to pivot back to the lower receiving position, said actuator being disengageable from the container support and the container when said container is in the lower receiving position following which said arm together with said actuator may be retracted inwardly toward the vehicle to allow the vehicle to move away from the container.

2. The actuator assembly of claim 1 wherein said actuator has engagement devices thereon which in use are adapted to be mutually co-operable with the container and container support and permitting secure pivoting of the container relative to the container support when the actuator is engaged therebetween via said engagement devices while permitting generally ready or rapid engagement and disengagement of the actuator with and from, respectively, the container and container support only when the container is in its lower material-receiving position.

3. The actuator assembly of claim 2 wherein said actuator includes a fluid cylinder having said co-operable engagement devices mounted thereto and said fluid cylinder being operable between extended and retracted positions corresponding to the material discharge and receiving positions respectively of the container.

4. The actuator assembly of claim 3 wherein opposing ends of said fluid cylinder have said co-operable engagement devices thereon, said engagement devices being adapted to securely engage compatible engagement devices on the container support and container when said cylinder is partly or fully extended and to provide for the ready or rapid engagement and disengagement of the actuator when the cylinder is fully retracted and the container is in its lower material receiving position.

5. The actuator assembly of claim 4 wherein said engagement devices each comprise a hook-like latch and each being secured to a respective one of the opposing ends of said cylinder.

6. The actuator assembly of claim 5 wherein each hook-like latch has a slot therein adapted to receive and engage with respective pins on the container and container support, each said latch having an arcuately curved outer periphery adapted to come into close proximity to guard means on the container and container support as the cylinder is being extended and retracted in such manner as to prevent escape of the pins from the respective slots of said latches until the container has reached the lower material receiving position at which point said latches can be disengaged from the pins and the actuator disengaged from the container and container support.

7. The actuator assembly according to claim 1 when adapted for use with a vehicle having a side-mounted loading bucket thereon and wherein said arm is sufficiently long or extendible as to permit said actuator to be placed into said operative engagement between the container and container support when the vehicle is located with its bucket alongside the container to receive the material during discharge therefrom.

8. The actuator assembly of claim 7 wherein said arm comprises a linkage mechanism comprising a plurality of rigid links pivotally secured together and capable of being folded into proximity with the frame of the vehicle to define retracted position of the actuator arm and said actuator carried thereby.

9. A garbage or recyclable material handling system comprising a plurality of material containers each pivotally mounted to respective supports at desired spaced apart locations for movement between a lower material receiving position and a partially inverted material discharge position, at least one materials collection vehicle constructed and arranged to communicate with respective said containers when the latter are in the discharge position to receive the materials discharged therefrom, said at least one vehicle having an actuator assembly mounted thereto including an arm extendable outwardly of said vehicle and having an actuator secured to a distal end of said arm, which actuator is adapted to be positioned to operatively engage between said container support and said container when said vehicle is located to receive said materials from said container, said actuator being operable to exert forces between said container support and said container to cause said container to pivot from said receiving position to said discharge position to effect discharge of said materials into said vehicle and to thereafter cause or permit said container to pivot back to the lower receiving position following which said actuator can be disengaged from said container support and the container and said arm together with said actuator retracted inwardly toward said vehicle to allow the vehicle to move away from said container.

10. The handling system of claim 9 wherein said actuator together with said container and container support have mutually co-operable latching and latch engagement devices thereon permitting secure pivoting of the container relative to said support when the actuator is engaged therebetween while permitting generally ready or rapid engagement and disengagement of the actuator with and from, respectively, said container and container support only when said container is in its lower material-receiving position.

11. The handling system of claim 10 wherein said actuator includes a fluid cylinder having said co-operable latching devices mounted thereon, said fluid cylinder being operable between extended and retracted positions corresponding to the material discharge and receiving positions respectively of said container.

12. The handling system of claim 11 wherein opposing ends of said fluid cylinder have said co-operable latching devices thereon and said container support and container have said latch engagement devices co-operably engageable with said latching devices to provide for said ready or rapid engagement and disengagement of the actuator when the cylinder is fully retracted.

13. The handling system according to claims 9 wherein said vehicle has a side-mounted loading bucket thereon with said arm being sufficiently long or extendible as to permit the actuator to be placed into said operative engagement between said container and container support when said vehicle is located with its bucket alongside said container to receive the material therefrom.

14. The handling system of claim 13 wherein said arm comprises a linkage mechanism capable of being folded into proximity with the frame of the vehicle to define a retracted position of the actuator arm and said actuator carried thereby.

15. An improved container assembly for use in a garbage or recyclable materials handling system, said container assembly being capable of co-operating with a materials collection vehicle having an actuator assembly mounted thereto including an arm extendible outwardly of the vehicle and having an actuator secured to a distal end of the arm, wherein the container assembly comprises:

a support frame adapted to be mounted to a base;

a material container pivotally mounted to said support frame for pivotal movement relative to said frame between a lower material receiving position and a partially inverted material discharge position, said container being adapted to communicate with the inlet of a materials collection vehicle when said container is in the discharge position such that the vehicle may receive the materials discharged therefrom;

said support frame and container being adapted to receive said actuator, said support frame and container having devices thereon enabling said actuator to operatively engage between said frame and said container when said collection vehicle is located to receive said materials from said container such that the actuator can exert forces between said container and said frame to cause said container to pivot from said receiving position to said discharge position to effect discharge into said vehicle and to thereafter cause or permit the container to pivot back to the lower receiving position following which said actuator can be disengaged and removed away from said container and frame to allow the vehicle to move away from said container assembly, and wherein said devices enabling said actuator to operatively engage said container and frame comprise engagement devices on both said container and said frame adapted to co-operate with said actuator to provide secure pivoting of the container relative to said frame when the actuator is operatively engaged therebetween while permitting generally ready or rapid engagement and disengagement of the actuator with and from said container and frame only when said container is in its lower material-receiving position.

16. The container assembly according to claim 15 wherein said container is adapted for use with and to discharge into a materials transporting vehicle having a side-mounted loading bucket thereon.

17. The container assembly of claim 15 when adapted for use with said actuator in the form of a fluid cylinder, opposing ends of which have latch devices mounted thereon and operable between extended and retracted positions defining the material discharge and receiving positions respectively of said container, said engagement devices on said frame and container being adapted to co-operate with the latch devices of the fluid cylinder to provide for said ready or rapid engagement and disengagement of the actuator.

* * * * *